United States Patent [19]

Súndermann et al.

[11] Patent Number: 4,708,642

[45] Date of Patent: Nov. 24, 1987

[54] PROCESS FOR THE THERMAL AND/OR CHEMICAL TREATMENT OF GRAINED, GRANULAR OR LUMP MATERIAL

[75] Inventors: Erich Súndermann; Hanno Laurien; Wolfgang Vahlbrauk, all of Braunschweig; Hans Reye, Neustadt, all of Fed. Rep. of Germany

[73] Assignee: Perfluktiv-Consult AG, Basel, Switzerland

[21] Appl. No.: 808,449

[22] PCT Filed: Mar. 16, 1985

[86] PCT No.: PCT/EP85/00115

§ 371 Date: Nov. 22, 1985

§ 102(e) Date: Nov. 22, 1985

[87] PCT Pub. No.: WO85/04467

PCT Pub. Date: Oct. 10, 1985

[30] Foreign Application Priority Data

Mar. 24, 1984 [DE] Fed. Rep. of Germany ..... 3410896

[51] Int. Cl.[4] ..... F27D 1/08

[52] U.S. Cl. ..... 432/95; 432/98; 432/14

[58] Field of Search ..... 432/14, 13, 95, 97, 432/98, 99, 100

[56] References Cited

U.S. PATENT DOCUMENTS 648,933 5/1900 Edison ..... 432/98
2,451,024 10/1948 Ellerbeck ..... 432/98
4,256,451 3/1981 Johnson, Jr. ..... 432/14

FOREIGN PATENT DOCUMENTS 31932 6/1885 Fed. Rep. of Germany ..... 432/98
1165477 3/1964 Fed. Rep. of Germany .
1243827 7/1967 Fed. Rep. of Germany .
1508476 2/1971 Fed. Rep. of Germany .
2707953 8/1978 Fed. Rep. of Germany .
2009900 6/1979 United Kingdom .

*Primary Examiner*—Henry C. Yuen
*Attorney, Agent, or Firm*—Karl F. Ross; Herbert Dubno

[57] ABSTRACT

In the process for the thermal and/or chemical treatment of grained, granular or lump material in plane heaps, the latter are transported with free intervals, in stages, from top to bottom through a shaft and are traversed by gases. The heaps lay on grates of which the bars may be taken out at least partially from the grate plane, temporarily and spatially, in such a way that the different heaps are disaggregated and fed in the form of a uniform gripping flow to the next stage so that a constant layer cross-section thickness is maintained. The introduction and evacuation of the gases are effected through side openings provided in the shaft wall in the cross-section which is not filled with the heaps. The uniform traversing flow of the heaps and the flow deviation of the material particles cause an advantageous thermal transfert of gas to the material particles of vice versa, while producing during the chemical treatment, an intensive reaction between the gas and the material particles with a high fluid mechanics efficiency.

7 Claims, 14 Drawing Figures

PROCESS FOR THE THERMAL AND/OR CHEMICAL TREATMENT OF GRAINED, GRANULAR OR LUMP MATERIAL

CROSS REFERENCE TO RELATED APPLICATIONS

This application is a national phase application of No. PCT/EP85/00115 filed Mar. 16, 1984 and based upon a German application of Mar 24, 1984 No. P 34 10896.3 under the International Convention.

FIELD OF THE INVENTION

The invention relates to a process and an installation for the thermal and/or chemical treatment of grained, granular or lump material in heaps, wherein the heaps are arranged in a plurality in a shaft one above the other and separated by free intermediate spaces provided between them, and, after a predetermined period of time spent on each level, the heaps are tranported in stages traversing the shaft from top to bottom starting respectively with the lowest heap and are acted upon in the shaft by gases or vapors introduced in the intermediate spaces.

BACKGROUND OF THE INVENTION

A process and an installation to carry out the process such as a burning shaft for cement, limestone, gypsum or the like are known (German Pat. No. 31 932), wherein the shaft interior and the column of material in the shaft interior which completely fills the shaft are subidivided by grate-like divider walls which can be extracted laterally from the shaft walling, forming chambers filled with material lying between grates arranged on top of each other. The combustion gases introduced into the shaft interior under the lowest grate traverse from bottom to top all the chambers, respectively the material in the chambers. When the material present on the lowest grate-like divider wall, such as limestone or the like is sufficiently burnt, the material is discharged by extracting laterally the subdivided lowest divider grate, before the following chamber load is transferred in the burning area to the lowest burning grate after the closing of this grate and subsequently thereto all the chamber loads above it are transported to one level below and the top dividing grate is again filled with material.

This way it is assumed that a continuous operation of the shaft furnace is made possible.

In this known process only a low flow velocity of the combustion gas with respect to the material column they have to traverse can be attained, which leads to the fact that the materials spend a long time on each individual level.

Besides, the process is limited to the treatment of such materials wherein the combustion gases can also be used for the preheating. Finally, bridging and thereby caused irregularities in the flow are unavoidable, whereby especially the bridging in the burning area can have correspondingly disadvantageous effects due to flow irregularities on the chambers located above, particularly in what the even preheating of the material is concerned. Finally, it is quite difficult to completely discharge the load of the respective upper chamber and to completely fill the lower chamber by laterally extracting the subdivided grate from the shaft wall. The irregularities occuring during this operation cause additional irregularities in the heating of the material within the individual cross-sectional-levels of the shaft. Due to the fact that the combustion gas is introduced exclusively from the bottom, a very high shaft results, which again has to lead to a further reduction of the flow velocity of the combustion gas and to the thereto connected disadvantages.

It also has become known to treat porous additives made of swellable materials in the manner afore-described (German published specification No. 1 165 477). Thereby, the crushed material, such as clay or oil shale, is charged into chambers of a shaft arranged one on top of the other and each chamber is only partially filled. The chamber bottoms are made of lamellae rotatable around their longitudinal axis. Between the heap in the respective chamber and the bottom of the following chamber located above it, there is an intermediate clearance and the combustion gases produced by burners arranged laterally on the shaft walling are fed into these spaces. Thereby, a mechanical loosening of the heap is also performed in order to avoid bridging in the material due to the fact that the bottoms are rotatably driven and provided with downwardly directed teeth which reach almost to the next bottom.

To improve on the afore-mentioned state of the art, a further development has become known (German published specification No. 1 243 827) with burning chambers bilaterally arranged on a shaft, which are connected to the shaft interior through openings in the shaft walling, whereby the shaft interior is again subdivided into chambers by bottoms made of rotatable traps. Through an appropriate control of the bottom traps of the individual shaft chambers and through a charging device alternately covering one of the two burning chambers an alternate blasting of the respective material falling from one chamber into the other takes place, and due to that a desired turbulence of the material occurs with the result of a more even heating of the individual particles of material.

In the case of all these known processes the heating of the invidual material particles is very uneven which leads to the fact that a part of the material is overheated and another part thereof has not reached the required final temperature so that only an uneven thermal and/or chemical treatment of the material can be carried out.

In the case of the last-described processes and installations there is the further disadvantage of a relatively low energy efficiency in the use of the combustion gases, since these practically only graze the respective chamber bottoms and the surfaces of the heaps of material to be treated or flow around the material only during the short period of time of its free fall, so that it is necessary to provide a multitude of chambers corresponding to the desired temperature of the material to be heated.

OBJECT OF THE INVENTION

It is the object of the invention to further improve a process as previously described so that a uniform thermal and/or chemical treatment of all material particles is reached on all levels, whereby a shortening of the time the material spends on each level is achieved and also differentiated temperature conduction, as well as a treatment of the material with differently combined gases and vapors on each level, is facilitated.

SUMMARY OF THE INVENTION

This object is achieved in accordance with the invention in that the quantities of material are prepared or selected to have the same grain- respectively lump size with approximately similar length- and width dimensions in the range of 6 to 100 mm and that during their transportation into the shaft, at the latest, they are evenly distributed over a surface corresponding to the cross section of the shaft, are then arranged in respective heaps having the same layer thickness over their entire cross section, that the heaps in the shaft are each supported by grates, that at least during one or several time periods spent on the grates the heaps are traversed in vertical direction with respect to the plane of the layer by gases or vapors introduced laterally into the intermediate spaces or removed from these intermediate spaces and after a predetermined period of stay, through a time-controlled discharge, at least one part of the grate bars are removed from the grate level and the heaps are released and directed towards the following grate as an evenly trickling flow, so that again heaps with a uniform layer thickness over their entire cross section are created.

Through the afore-mentioned process, it is possible to treat different materials, whereby either a heating or a cooling, respectively both successively can be performed, as well as to treat the grained- respectively lump material, in the conditions of more or less stable temperatures, with a gas in order to obtain certain chemical reactions.

As a few practical applications of this process the following should be mentioned: the deacidification of limestone, dolomite, gypsum, magnesite, apatite, further the hardening, carburation, nitrification or tempering of metallic materials, as well as for refining and tempering of non-metallic, organic materials, for the drying of granulates containing alumina silicate, for the preparation of the subsequent swelling process, for the low-temperature cooling of food with the above mentioned grain size or piece size, such as small pastries, respectively bread rolls or the like.

In order to achieve an even treatment of all particles of material it is important to arrange these in heaps on individual levels having the same stable layer thickness, whereby due to the generally equal size of the particles sufficient empty spaces are left to permit the introduced gases or vapors to traverse the material to surround evenly the individual particles of material and at the same time, to create an intensive vorticity of the gases or vapors in the empty space intervals which leads to a better heat transfer during the thermal treatment between the particles of material and the gas and to an intensive contact between the components of the gas and the particle surface during the chemical treatment, resulting in an intensified reaction between the particles of material and the gases or vapors.

Since the gases and vapors are laterally introduced through the shaft walling into the space intervals between the adjacent heaps and after travelling vertically through the heap, with respect to the level of the layer, are again laterally evacuated from the shaft, the heaps arranged on individual levels or in groups of levels can be treated with gases or vapors of different temperatures, respectively different chemical compositions, so that for instance after a preceding heating a cooling of the material particles can be obtained, or in order to conclude a preceding chemical treatment or to interrupt it intermittently.

The grates permitting the flow through the heaps also facilitate, through corresponding control of their extraction, at least of the extraction of a part of the grate bars from the grate level, the transfer of the material in an evenly trickling flow to the following level which is favorable for an even distribution over the entire cross section surface of this level. The desired trickling flow can be produced either by a time-controlled lifting and/or a time controlled lowering of a part of the grate bars, whereby the lift travel, respectively the lift height and the transfer of the grate bars in two or three different levels can be adjusted depending on the material and the shape of the particles of material and the most favorable results can be preestablished through corresponding trickling tests. The described controlled grate movements also destroy the possible bridging effects that can occur in the material in individual levels.

The direction of the gases or vapors travelling through the heaps can be differently selected in accordance with the dependent claims, wherein the layer thickness, the temperature-, or the concentration variations of the gases or vapors are important factors.

It was established that when heating a material using a two-way current through the charge, the desirable heat efficiency for the purpose of temperature uniformization in the charge during its convective heating is lower than the heat efficiency during convective heating with an one-way flow, under otherwise similar conditions.

In order to use the advantage of the one-way flow for the process wherein the gases enter the shaft-like enclosure in each second space interval between the heaps and exit this enclosure through respectively each other second interval, the direction of the flow of the gas stream is switched each time during the time period in which the bulk material falls down to the next level.

Due to this switching of the flow direction of the gas stream, each individual body of lump material is exposed during its entire stay in the shaft to the advantageous one-way gas flow of the described process.

The flow velocity, with reference to the clear cross section of the shaft, which means the velocity of flow of the material from the initial direction, is in the case of the new process of 1 m per second to about 4 m per second, the average height of the heap lies in the range of 0.1 to 0.3 m, depending on the grain- respectively lump size, and the station times, respectively the individual treatment duration in each of the levels, lying in the range of 2 to 10 minutes. The trickling time, as a rule, amounts to 2 to 4 seconds.

Due to the afore-described guiding of the gases or vapors, it is possible to subject these gases or vapors to an intermediate treatment after they travelled through one or more heaps, for instance an intermediate cooling or an intermediate reheating, or in the case of chemical reactions a resupply of the gases or vapors with reactants in order to increase or decrease the concentration thereof, depending on the reactions intended between the gases or vapors and the heaps of material.

In the treatment of a heap which tends to become densely packed or to form bridges it can prove appropriate to protect the heaps in the case of a flow coming from below against the oncoming and through-flow of the gases or vapors, at least partially and in changing locations, during a few station periods, and in the remaining areas to provide the flow up to the point or over the point when the material starts to loosen up. When thereby due to the partial intensive flow treatment during the loosening process and the movements of the particles, these partially reach areas which are not subjected to the flow, they are guided back by switching the partially flow-treated and partially untreated areas, so that the even layer thickness of the material is preserved, in spite of this partial loosening and movement of the material.

In practice, it has been proven suitable in many instances to shield one or more heaps in the shaft against the flow of gases and vapors. This is for instance suitable in the case of the top heap in the shaft, which becomes this way a barrier against the gases or vapors flowing through the lower heaps. Such barriers can be provided in a common shaft between areas of different treatments, wherein the heaps located between these treatment zones are shielded against the flow of gases or vapors.

The installations to carry out the process are basically shafts, whose interior space is subdivided into chambers for the heaps by means of intermediate bottoms, wherein the adjustable bottom elements for the conveying of the heaps in charges through the shaft, as well as the shaft walling are provided with clear passages to at least part of the chambers.

In accordance with the invention, these installations are characterized by the fact that the intermediate bottoms forming the chambers are made of gratings and that all gratings are made at least partially of movable bars with actuation devices having controllable drives for the temporary augmentation of the clear spaces between neighboring grating bars through removal of a part of these bars from the grate level and that with the passages in the shaft wallings, gas or vapor supply- and evacuation ducts are connected with these controllable drives.

The shaft wallings can be constructed in various ways, depending on the intended use. For instance, in the case of burning processes, they can be provided with corresponding high-temperature resistant casing, or in the case of low-temperature cooling processes, with corresponding isolation against heat, whereby a construction made of annular closed module parts, each with a grating and passages in the walling for the supply and evacuation of gases or vapors is particularly advantageous for the construction of shafts with variable heights from largely prefabricated parts.

BRIEF DESCRIPTION OF THE DRAWING

The drawing illustrates embodiments of installations for carrying out the process.

In the drawing

SPECIFIC DESCRIPTION

Figure 1:
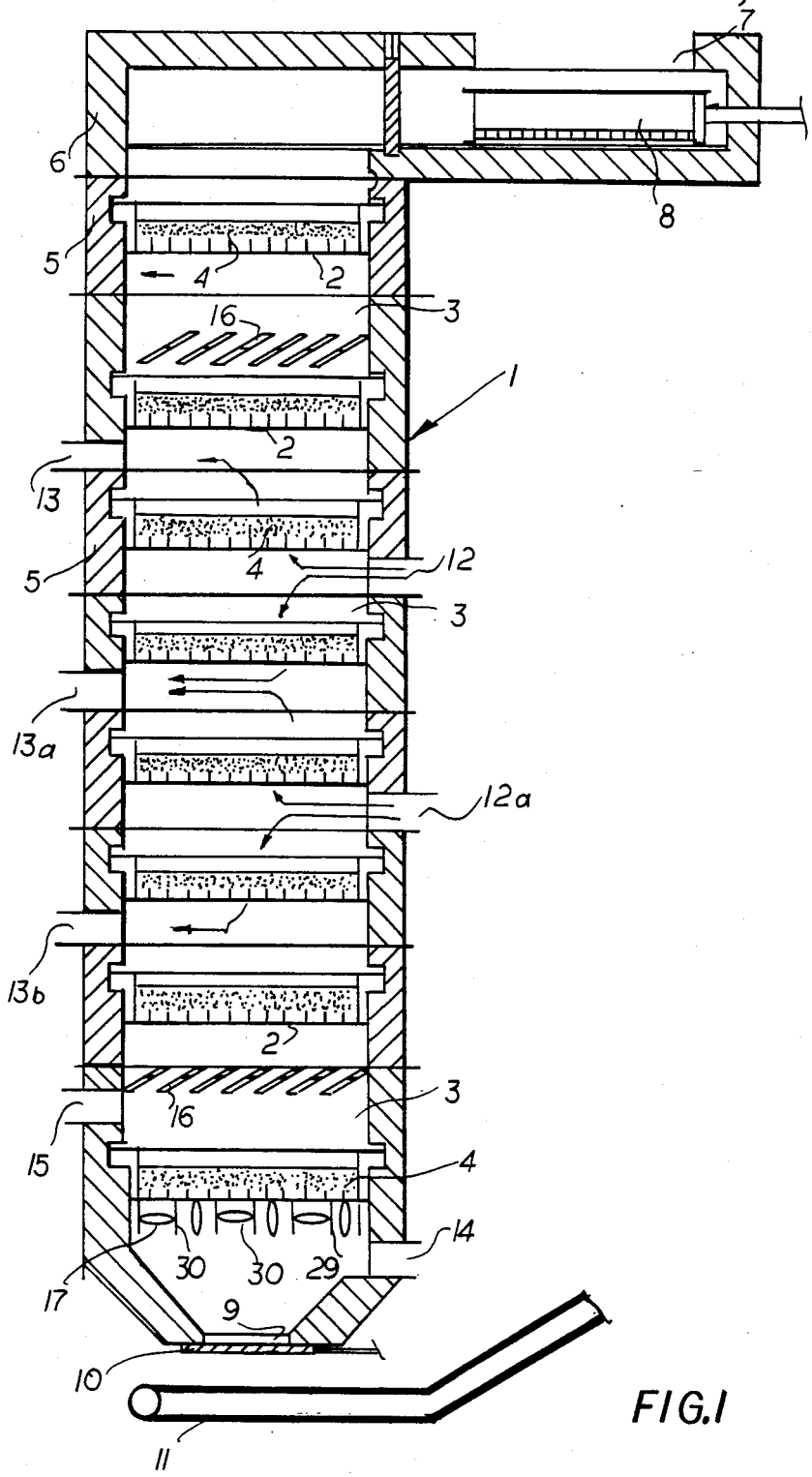
FIG. 1 is a longitudinal section through a shaft according to the invention, with different treatment areas of the material.

The shaft illustrated in FIG. 1 has a shaft walling 1 of square or rectangular cross section. In the shaft walling 1 of the shaft, gratings 2 are arranged at a distance from each other, one on top of the other, so that between the neighboring grating each time a chamber 3 is formed, which is only partially filled by plane heaps 4 of the grained- or granulated, respectively lump material to be treated and that between each surface of the heap 4 and the grating 2 located above it a clear intermediate space is created.

In the represented example, the shaft is built of annular, closed module parts 5 arranged on top of each other, each containing a grating 2, so that the shaft can be constructed with variable height and a variable number of levels by using a corresponding number of module parts 5. At its bottom the shaft is provided with a discharge opening 9 for the materials treated in the shaft, which. can be closed by means of a slider 10. Under the shaft a conveyor 11 can be seen, which transports the material exiting the shaft towards further processing or working areas. On top, the shaft is closed. by a cover housing 6 built like a charging chute. In the laterally extending portion of the cover housing 6 a metering- and distribution device 7 is schematically represented, in which the amount of material destined to form one heap 4 is received one at a time and wherefrom it is transported in the form of a flat heap with uniform layer thickness over its entire cross section to a movable molding box 8, which is closed downwardly by a grating corresponding to the grating 2 in the module part 5 of the shaft and which is equipped with an actuation device not shown in the drawing in order to remove at least one part of the grate bars from the level of the grating, which will be described further in connection with the gratings 2.

In the shaft walling 1, in the chambers 3 respectively in the clear space intervals formed by the chambers there are inlet - and outlet passages 12, 12*a*, 13, 13*a* and 13*b*, as well as 14 and 15 which are connected with corresponding gas-supply, respectively-evacuation ducts not shown in the figure and which at their turn lead to conveying devices or respectively preparation installations for the gases or in given cases of the vapors, depending on which gases or vapors the material in the heaps 4 is to be treated.

In the shaft represented in FIG. 1, between the two top gratings 2 respectively the two top chambers 3 a divider wall is provided made of swingable lamellae or vanes 16 and transferrable in an open or closed position through the adjustment of the lamellae. A similar divider wall made of lamellae 16 is mounted between the lowest chamber in the shaft and the chamber immediately thereabove. Finally below the lowest grating 2 in the shaft one can also discern the presence of a grid-shaped insertion 29, which serves to form parallel stream channels 30, and wherein traps 17 are mounted which are rotatable around horizontal axles 27, 28 and which can assume a partial closing or a partial passage position.

Figure 2A:
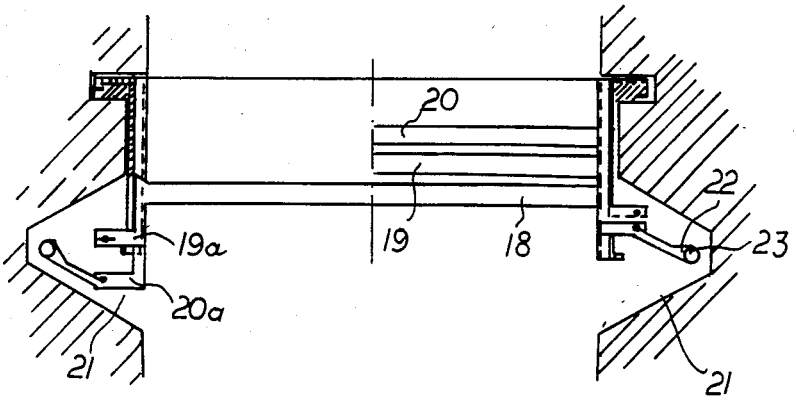
FIG. 2*a* is an enlarged representation of a part of the section according to FIG. 1 at the height of a grating, wherein details of the grating arrangement can be discerned.
Figure 2B:
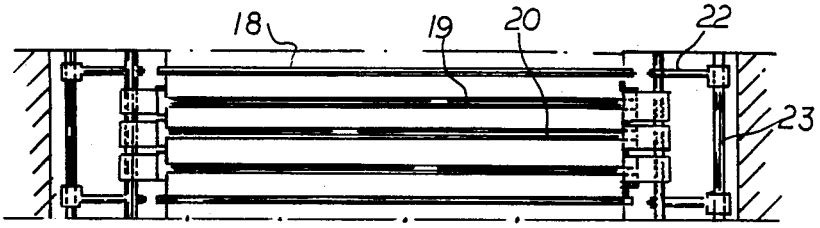
FIG. 2*b* is a top view of the arrangement, according to FIG. 2*a;*

The gratings 2 arranged in the shaft consist in accordance with FIGS. 2*a* and 2*b* partially of fixed grate bars 18, as well as of partially movable grate bars 19 and 20, whereby the latter are removable upwardly from the grating level with respect to the fixed grate bars 18, in order to temporarily augment the clear space intervals between neighboring grate bars.

In the FIG. 2*a*, to the left, the position of the grate bars 18 to 20 in the grating level is shown, while to the right, the grate bars 19 and 20 are shown in visibly raised position with respect to the grating level. For the raising of the grate bars 19 and 20, crank- respectively swivel arms 22 are provided in the recesses 21 on the inside of the shaft walling 1, which can be swung from the outside over an actuation shaft 23. The movable grate bars 19 and 20 are longer than the fixed grate bars 18 and are built as a construction unit that can be lifted and lowered, whereby the prolongued part of the grate bars 19 and 20 presents, according to FIG. 2*a*, the shape of angled bendings 19*a* and 20*a* of different length. As a consequence, the grate bars 19 and 20 are transposed to different height levels when they are moved due to the swinging motion of the crank arms 22 around the swivel axis 23, as can be seen in the right side of FIG. 2*a*.

Figure 3A:
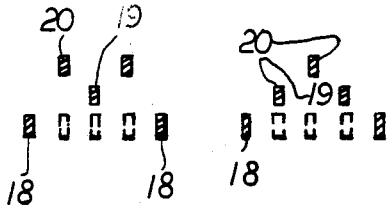
FIGS. 3*a* and 3*b* show possible positions of the grate bars in their arrangement and construction according to FIGS. 2*a* and 2*b;*
Figure 3B:
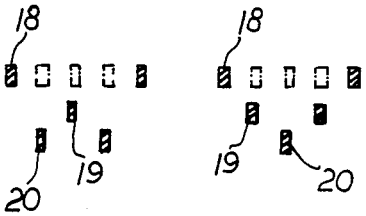

Instead of lifting the movable grate bars 19 and 20, it is also possible to perform the contrary movement of lowering these grate bars, so that depending upon the lifting, respectively lowering of the grate bars 19 and 20 different positions of the grate bars with respect to each other can result, as is shown for instance in FIGS. 3*a* and 3*b*.

Figure 4:
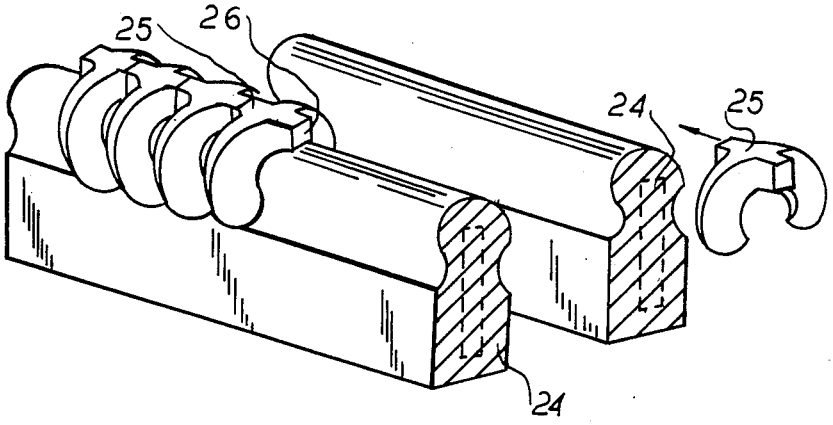
FIG. 4 shows two grate bars in perspective with partially raised straddling profile parts.
Figure 5:
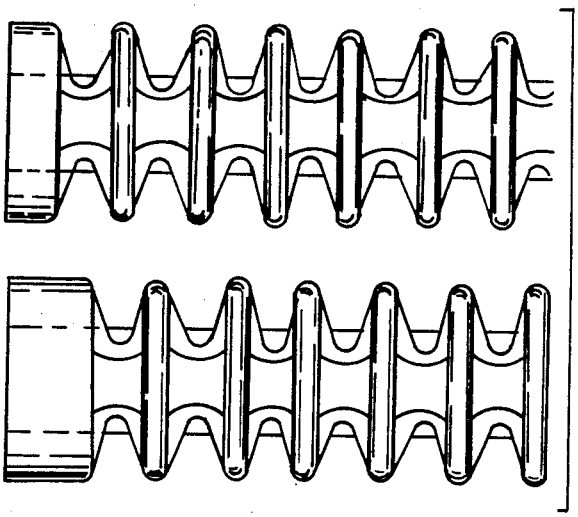
FIG. 5 is a partial top view of grate bars according to FIG. 4 with raised straddling profile parts.
Figure 6:
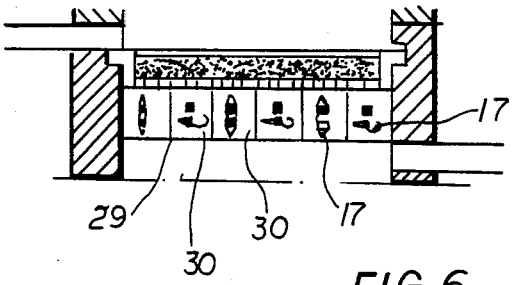
FIG. 6 is a partial longitudinal section through the area of the lowest level of the shaft according to FIG. 1.
Figure 7:
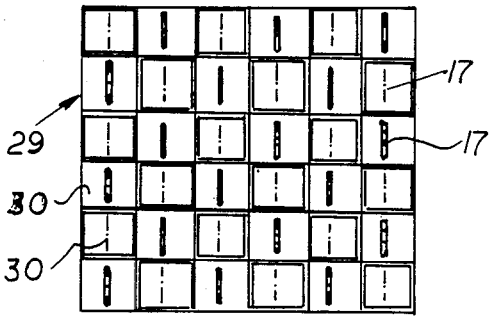
FIG. 7 is a view from below against the traps distributed over the cross section of the shaft according to FIG. 1.
Figure 8:
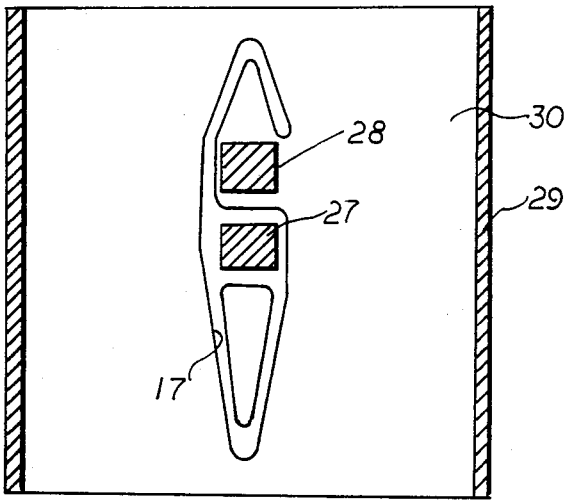
FIG. 8 is an enlarged representation of the cross section of one of the traps according to FIGS. 6 and 7.

The grate bars schematically represented in FIGS. 2*a* and 2*b* have in practice the suitable shapes illustrated in FIGS. 4 and 5. It can be seen that the grate bars, which can be made of solid or hollow profiles, have, when considered in cross section, at their upper part an undercut profile 24 and are equipped with superimposed and changeable straddling profiles 25, which can be slid on the grate bars. The straddling profiles have a horseshoe shape and are provided with extensions 26 in the direction of the grate bars, serving as buffers for the neighboring straddling profile parts. By tightly packing the straddling profile parts on the grate bars a configuration of the grate bars results, as can be seen in the top view of two neighboring grate bars in FIG. 5.

The straddling profile parts 25 prevent the lowest layer of the material in each of the heaps 4 from jamming the intervals between the neighboring grate bars, even when the material consists of cylindrical particles, in which case the particles would definitely arrange themselves in rows in the intermediate spaces between the gratings due to the rolling motion of the particles, in the absence of the straddling profile parts 25. The straddling profile parts can have different diameters with a given distance between the grate bars, so that thereby the percentage of the clear cross section for the passage of the flow through the gratings 2 can be correspondingly established, respectively changed. It is further possible to influence the local flow-passage conditions by using straddling profile parts 25 of various cross sections.

The shaft shown in FIG. 1 can for instance be intended for the heating or for the cooling of a material to be treated in the heap 4. For this purpose, the passages 12 and 12*a* can be connected together to a blower, while the passages 13, 13*a* and 13*b* are connected to a common gas evacuation duct, which in given cases can be a closed-circuit duct and, for instance, can be connected again with the blower via a heat exchanger. The heap 4 which is at the lowest level in the shaft can be subjected to a treatment by the supply of a different gas or a differently tempered gas, whose evacuation can also occur in given cases through a closed-circuit gas duct through the in- and outlet passages 14, respectively 15. Thereby, in the mentioned lowest heap a partial through-flow can be established with the grid-like grate insertion part 29 in cooperation with the traps 17 and due to the selection of a corresponding velocity of the flow, the loosening point of the material in the heap is reached or respectively surpassed, so that in the area of the channels 30 where the flow passes through a partial movement of the material particles takes place and these reach the areas where the flow does not pass through, due to the effects of the loseening and the flow. Through a change in the position of the traps 17 a reverse guiding and a return movement of the material particles can be attained. This modus operandi is particularly advantageous when during the passing of the flow through the lowest heap the material particles tend to stick together. Due to the presence of the lamellae 16 above the lowest heap, a separate treatment area is created for this lowest heap. Thereby, the heap located above the lower lamellae 16 becomes an additional barrier zone, through which no treating gas flows. Opposite thereto, in the illustrated example, the four heaps following in the direction of height are traversed in the direction of the arrows partially from top to bottom and partially from bottom to top due to a connection of the passage openings 12 and 12*a* to a gas supply duct and the treatment gas is evacuated through the outlet openings 13, 13*a* and 13*b*. The mentioned outlet openings can be connected to a common gas evacuation duct. Due to appropriate control devices, the direction of the gas flow with respect to the arrows can be reverted without difficulties, so that changes in the flow direction during the period of time spent by the heap on the individual levels can be operated without further ado.

The second heap from the bottom in the shaft illustrated in FIG. 1 can again function as a barrier layer, since above this heap a further dividing wall consisting of swingable lamellae 16 is provided and is in the closed position when the flow traverses the heaps. The aforementioned heap is always created in the span of time during which the other heaps are traversed by the flow in the described manner.

When the heap which is the lowest in the shaft reaches its final stages intended by the flow treatment this heap is dissolved due to the removal of the movable bars of the grate, which sets the grating in open position, and through the open slider 10, it is discharged onto the conveyor 11. After the return of the movable grate bars to the same level with the fixed grate bars, the swingable lamellae 16 located above this grating are swung into the open position and, through a time-controlled actuation of the grate bars of the grating arranged on top of the lamellae, the heap resting on this grating is dissolved in the above-described manner and is directed in the form of a free-falling laminar trickling flow towards the lower grating, so that a uniform layer thickness over the entire cross section of the shaft is ensured. This process repeats itself from grating to grating, until the top grating of the shaft is empty. In the closed position of the lamellae 16 located at the top of the shaft, the material for the formation of the uppermost heap is then transferred into the shaft through the molding box 8.

During the described method of operation of the shaft according to FIG. 1, depending on the nature of the material and of the gases, a drying or heating, respectively a cooling of the material and/or a chemical treatment thereof can take place by using corresponding gases or vapors. Several examples of different material treatments are described in connection with FIGS. 10 to 12.

But first the FIGS. 6 to 9 are referred to, these showing details regarding the arrangement and shape of the traps 17 rotatable around their horizontal axes within the flow channels 30 of the grid-like grating insertion 29. The traps 17 are held in the flow channels corresponding to the fields of a chessboard so that neighboring traps are always differently positioned. In order to simultaneously change position of all the traps 17 assuming the identical position located in one row, two horizontal axles 27 and 28 located one above the other are provided as in FIG. 8, and the traps 17 of each row are alternately held thereon. In the practical embodiment according to FIG. 8, the traps 17 supported by the axle 27 receive the traps adjacent at the moment in a recess of the axle 28, so that the axles 28 do not hinder the swinging motions of the traps supported on axle 27. This way it is possible to set all traps in the closed position or all traps in the open position, respectively to set the neighboring traps in different positions.

When it is necessary to work in the shaft with gases with a high temperature of 1,200° to 1,600° C., the described grating with all carrying parts of the gratings, as well as the grid-like grate insertion 29 and the therein contained traps 17 with the supporting axles 27 and 28 are made of SiSiC or reaction sintered SiC and suitably with a coating layer of boron nitrite, so that in the case of fusion at the surface of the individual material particles a sticking of this particles to the mentioned parts of the gratings, respectively grid-like grate insertion, is avoided.

Figure 9:
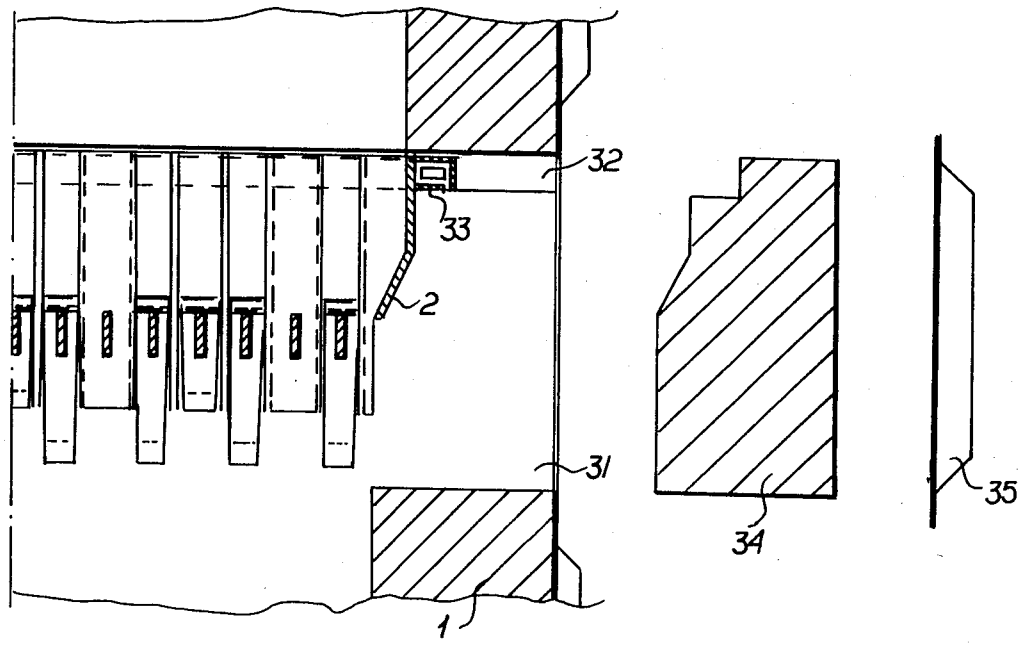
FIG. 9 is a partial longitudinal section through a shaft with laterally insertable gratings.

Instead of the construction type based on modules of the shaft, as described in FIG. 1, the shaft walling 1 can also be constructed as one continuous shaft walling having window-like openings 31, corresponding to the example of FIG. 9, wherein the gratings in the shape of the already mentioned construction units are laterally insertable. Thereby, the gratings consisting of the already-described fixed and removable bars, are held by carrying devices 33 in groove-like recesses 32 in the lateral shaft wall. For the closing of the window-like openings 21 in the shaft walling 1 an adjusted panel 34 in connection with a cover plate 35 is provided, said plate being bolted to the shaft walling 1 after the panel 34 is inserted. Due to the afore-mentioned construction, it is possible to exchange the gratings built as a unit with minimum effort.

Figure 10:
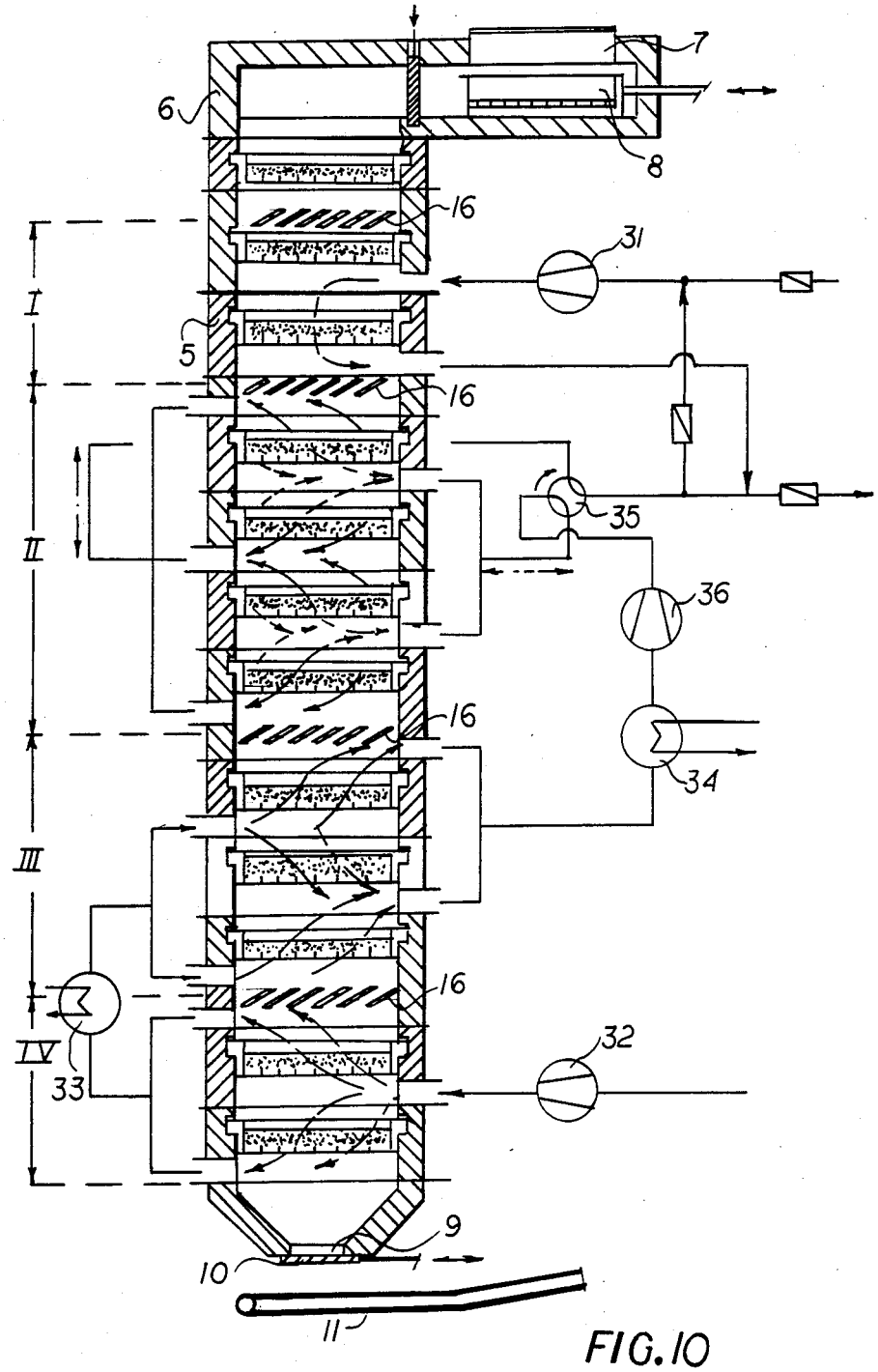
FIG. 10 is a longitudinal section through a shaft similar to FIG. 1 for the drying of granulated raw materials containing aluminum silicate, such as clay and the like, with the aid of which the course of the mentioned drying process is explained.

The shaft illustrated in section in FIG. 10 shows a widely similar construction to the shaft represented in FIG. 1 and precedingly described. In FIG. 10, the parts which are identical to the ones in FIG. 1 are marked with the same reference numerals.

With the aid of the representation of FIG. 10, the drying process of granulated raw material containing aluminum silicates is to be described more in detail.

The shaft is again constructed of modular parts 5 with the walling of these modular parts being equipped with inlet- respectively outlet passages for the gas. The shaft is subdivided in the direction of its height into four sections I to IV by the lamellae 16 arranged on top of each other and forming divider walls, as marked laterally alongside the representation of the shaft. The top section I is a warming section for the material introduced from above into the shaft, with the three drying section II to IV following in downward direction.

One can assume that in the represented shaft cylinder-shaped granules with a longitudinal and transversal size of about 16 mm and a humidity of about 20% are present. In the case of the heap dimensions of 100×1,200×1,200 mm determined by the cross section of the shaft, a total heap weight of approx. 250 kg results.

The intervals between the grate bars and the straddling profiles arranged on the grate bars are so selected that, when the grating is in closed position, the proportion of the surface left clear for the passage of the gas is of about 38%.

The gas supply to the heaps of material takes place with a flow velocity of approx. 0.9 m per second.

The supply and evacuation of the hot gases, respectively hot air, traversing the heaps of material can be seen from the schematically shown switching system and from the arrows marked in FIG. 10, wherein one can discern the possibility of the reversal in the flow direction through a part of the heap from the partially dotted representation of the double arrows.

The supply of the heated air or hot gases to the warming section I takes place due to blower 31 and the supply of the air to the third drying section IV through the blower 32. In the switching installation heat exchangers 33 and 34 are recognizable actuated over burners or other heating devices, provided between the drying sections II and III, respectively III and IV. In the area of the drying section II a rotatable slider 35 in the form of a four-two-way valve is also provided.

In the heating section I the heap located under the top heap functioning as a barrier is traversed due to the blower 31 by a gas in one direction as shown by the arrow, the gas having a temperature of 150° C. In the drying section II the material present on the gratings located in this section. is traversed from an alternate direction by a gas having a temperature of 200° C. In the drying sections III and IV, the material is heated to the maximum temperature admitted during drying of approx. 200° C., whereby the gas supplied by the blower 32 to the shaft in the drying section IV is reheated by the heat exchanger 33 after traversing both lowest-lying heaps, before it is resupplied to the heaps in the drying section III, wherefrom it is directed through the heat exchanger 34 and the subsequently arranged blower 36 to the drying section II.

The station time of the individual heaps on the gratings is of approx. 2 to 4 seconds.

Figure 11:
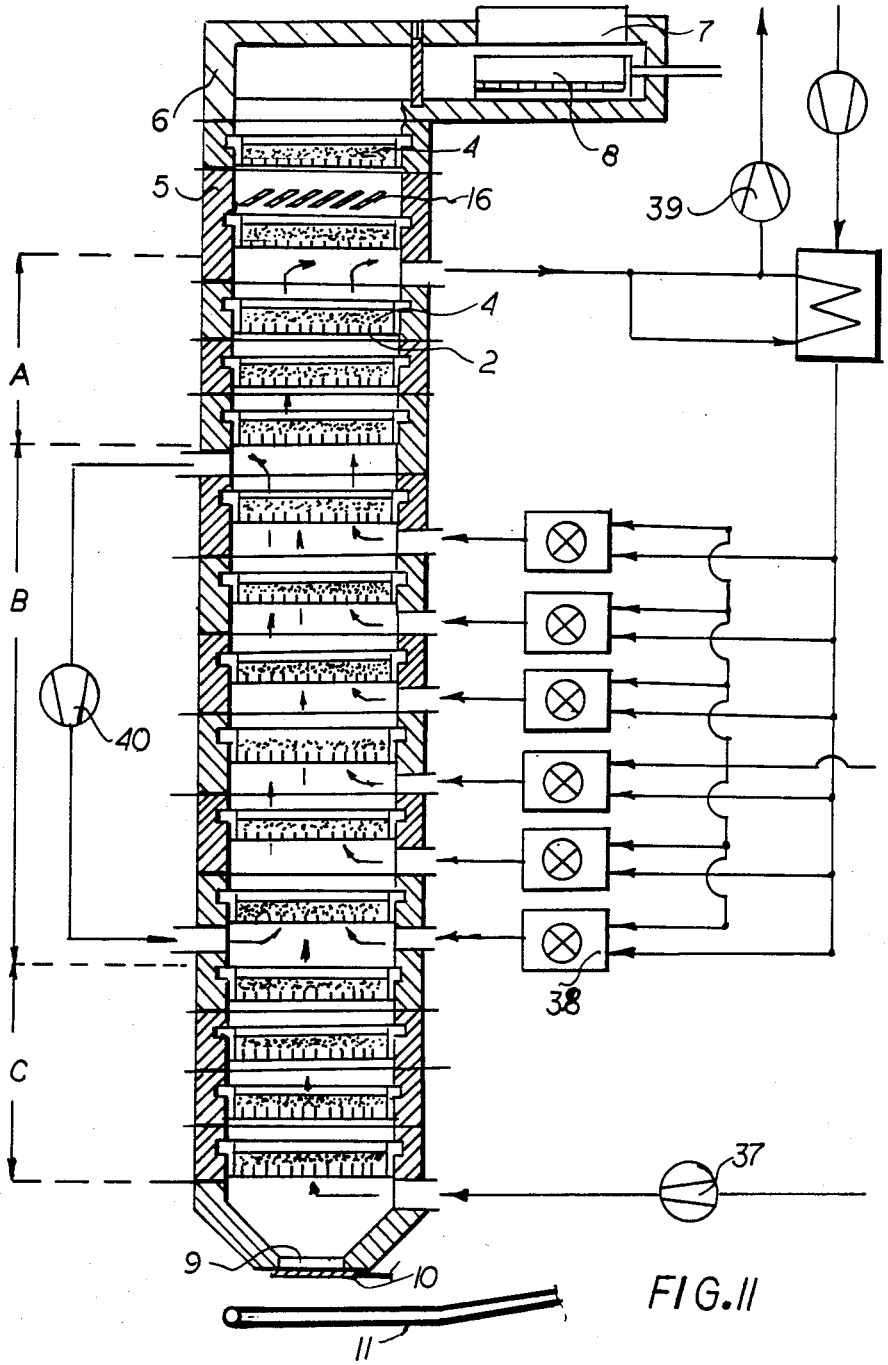
FIG. 11 is a view similar to FIG. 10, showing a section through a shaft for the burning of limestone, with the aid of which the example of the limestone burning process is explained.

A slightly modified embodiment and operation mode of the shaft is shown in FIG. 11. This figure shows a shaft according to the invention suited for the burning of limestone.

In this figure the parts of the shaft already described in the preceding figures have the same reference numerals as in these preceding figures.

The shaft according to FIG. 11 is again built of modular parts 5 and in this example is subdivided in three sections over its height, extending from the uppermost heap functioning as a barrier, below the divider wall consisting of lamellae 16, down to the discharge opening 9.

The upper section A is a preheating area extending over three heaps of material. The section B following in downward direction is a burning area extending over a height of six heaps. The section C following it in downward direction is a cooling area, comprising a totality of four heaps.

The guiding of the flow can be seen from the operational diagram. This shows the supply of the cooling air via a blower 37 to the lowest heap as well as the supply of combustion gases produced by burners 38 located outside the shaft to the individual clear cross sections for the passage of the flow between the heaps of the burning section B. The evacuation of the gases from the shaft takes place above the uppermost heap of the preheating section A via a blower 39. The marked arrows show the flow direction as well as the possible reversal or closed-circuit guidance of a part of the gases through the individual sections.

In the illustrated example the processing gas flows through the shaft furnace in a direction opposite to the materials. The cooling air entering the cooling section C travels through the heaps in the cooling section and is then heated, mixed with the combustion gases furnished by the burners 38 and directed to the burning section B, it then passes the burning area B and reaches the preheating section A, from where it is evacuated. For the control of the pressure in the burning area the provided suction fan 40 has an essential contribution to the redirection of a part of the burning gases in the burning section B through a return duct. Through a corresponding adjustment of the blowers 37 and 39 a very precise control of the pressure situation over the entire height of the shaft can be achieved.

In the treatment of lime lumps with a particle size of 10 to 20 mm and heaps with a height of approx. 16 cm, as well as gas temperatures of approx. 1,200° C. in the area of the burning section B, the station time of the heaps on the individual grating levels resulting in a shaft according to FIG. 11 will be of approx. 6 minutes, when in the burning section B the flow velocity of the gas streaming through the clear intervals between the heaps is set to approx. 2 to 4 m per second. The trickling time necessary for the transportation of the individual heaps from one grating to the other lies in the range of 2 to 4 seconds.

Figure 12:
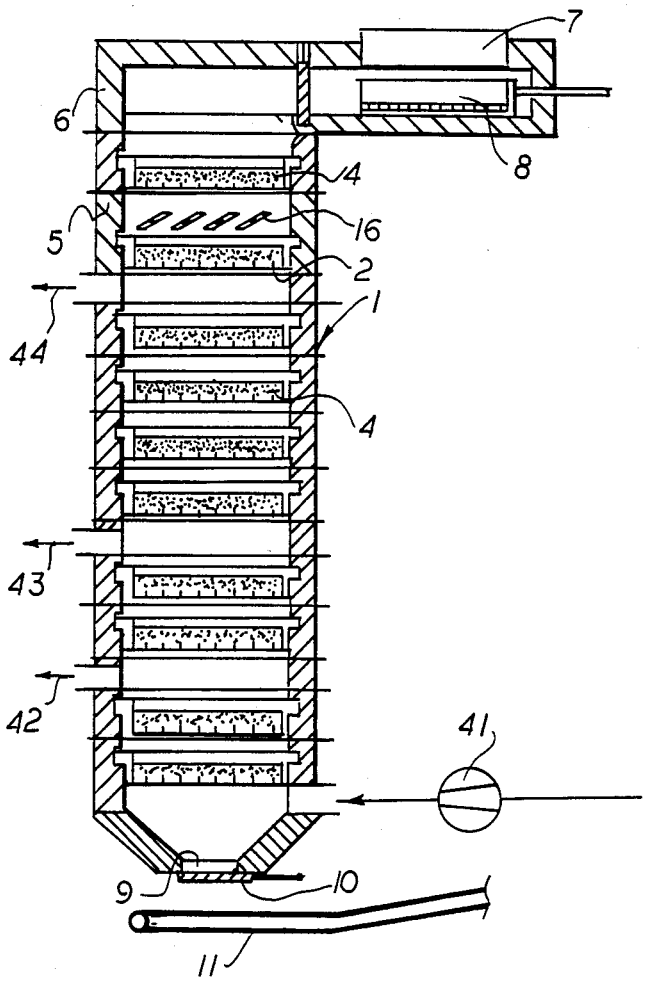
FIG. 12 is a section through a shaft similar to FIGS. 10 and 11, with the aid of which the example of the cooling of cement clinker is explained.

The construction of a shaft for the cooling of cement pellets can be seen from the schematic representation of FIG. 12, which also shows the relatively simple switching installation for the cooling air.

In FIG. 12, the parts which are identical to parts shown in the other illustrations of the shaft in FIGS. 1, 10 and 11 are designated with the same reference numerals.

The represented shaft has all together eight levels, respectively gratings 2 with the heaps 4 resting thereon which are arranged within the shaft in an already-described manner underneath a heap functioning as a barrier and a divider wall located thereabove consisting of swingable lamellae 16. The supply of cooling air takes place via a blower 41 in the space below the lowest heap. This cooling air travels through the heaps from bottom to top, whereby a part of the supplied cooling air after passing through the two lowest heaps and a further part of the cooling air after passing through the four lowest heaps is evacuated in the direction of the arrows 42 respectively 43, while the remaining cooling air continues to travel further upwardly through the following four heaps and is then evacuated in the direction of the arrow 44 when it reaches the area beneath the barrier heap. Through the corresponding arrangement of controllable throttling devices in the air-evacuation ducts, not shown in the drawing, the respective portions of the cooling air exiting the shaft in the direction of the arrows 42 to 44 can be used for any desired drops in the temperature of the material over the entire height of the shaft. The cooling air exiting the shaft in direction of the arrows 42 to 44 which is heated to various degrees can be redirected over heat exchangers for further use of the heating energy evacuated from the shaft, in given cases redirected in the closed circuit to the blower 41, whereby it is self-understood that in this circuit a dust-removing device has to be provided, since it is unavoidable for all the shafts constructed in accordance with this invention with similar travel of the heaps through the shaft from top to bottom, from level to level, to produce dust due to friction.

For all the illustrated embodiments it is important to introduce plane heaps of material having the same height over the entire shaft cross section each time, and to preserve this shape each time after the transfer of the heaps from grating to grating through correspondingly controlled movements of the grate bars and a thereby produced uniformly trickling stream of material, whereby the necessary course of displacement of the grate bars has to be established through trickling tests, depending on the structure and the nature of the material.

The described construction and the operation mode of the new shaft lead at the same time to a uniformization of the flow travelling through the heaps and to an improved efficiency from the point of view of the flow mechanics, meaning the ratio between the transferred effort and input of mechanical effort. In comparison with the traditional installations, with the new shaft the processing time of the material can be reduced to 25% and partially even lower than that, also a more careful processing can be achieved.

When the shaft is operated under the use of gases with higher temperatures up to 1,350° C. it has proven suitable to use SiSiC for the grate bars and the remaining carrying parts of the grating, as well as for the grid-like insertion, when such an insertion is provided, and the therein contained traps and axles, and in the case of even higher temperatures up to 1,600° C., to use reaction-sintered SiC.

We claim:

1. An apparatus for treating a flowable solid material, comprising:

a column;

a multiplicity of vertically spaced horizontal bar grates in said column receiving respective gas-permeable flat layers of said flowable solid material of a thickness such that above each such layer a respective free space is maintained, at least some of the bars of each of said grates being movable;

means for laterally inducing at least one gas into one of the free spaces on each side of a respective layer while laterally withdrawing the respective gas from another free space on an opposite side of the respective layer to cause the respective gas to traverse the respective layer perpendicularly to the plane of the layer and uniformly over the horizontal cross section thereof, at least some of the grate bars of each grate being movable to induce said material to trickle uniformly over the cross section of the column from each upper grate downwardly onto the next lower grate to form a new flat layer of material on each next lower grate which is uniform in thickness over the entire horizontal cross section thereof; and means on said column for moving the movable grate bars to induce said material to trickle downwardly, said means on said column for moving the movable grate bars of each grate is connected to at least one assembly of grate bars shiftable out of the respective plane.

2. The apparatus defined in claim 1 wherein said column is provided at the top thereof with a device for the uniform distribution of said material over the entire cross section of said column to form an uppermost layer on the topmost one of said grates.

3. The apparatus defined in claim 1 wherein said means on said column for moving the movable grate bars includes a lifting device.

4. The apparatus defined in claim 3 wherein said lifting device includes a crank assembly engaging end portions of the respective grate bars.

5. The apparatus defined in claim 1 wherein said column is assembled from modular units each provided with one of said grates and respective passages forming said means for laterally introducing and laterally withdrawing the respective gas.

6. The apparatus defined in claim 1 wherein each of said grates is a structural unit laterally insertable through a window formed in said column.

7. The apparatus defined in claim 1 wherein each of said grate bars as seen in cross section has an upper portion with an undercut profile and is equipped with a straddling profile part preventing jamming of said material into spaces between neighboring grate bars.

* * * * *